US006843304B2

(12) United States Patent
Takeuchi et al.

(10) Patent No.: US 6,843,304 B2
(45) Date of Patent: Jan. 18, 2005

(54) CERAMIC PLATE FOR SIDE WEIR OF TWIN DRUM TYPE CONTINUOUS CASTING APPARATUS

(75) Inventors: Tomohide Takeuchi, Hikari (JP); Koji Kono, Kitakyushu (JP); Kiyoshi Sawano, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/031,317

(22) PCT Filed: May 17, 2001

(86) PCT No.: PCT/JP01/04138

§ 371 (c)(1),
(2), (4) Date: Jan. 16, 2002

(87) PCT Pub. No.: WO01/87517

PCT Pub. Date: Nov. 22, 2001

(65) Prior Publication Data

US 2002/0104640 A1 Aug. 8, 2002

(30) Foreign Application Priority Data

May 17, 2000 (JP) ..... 2000-144980

(51) Int. Cl.[7] ..... B22D 11/06; B22C 1/00
(52) U.S. Cl. ..... 164/428; 164/480
(58) Field of Search ..... 164/428–429, 164/479–480

(56) References Cited

U.S. PATENT DOCUMENTS

| | | | | |
|---|---|---|---|---|
| 4,640,336 A | * | 2/1987 | Arakawa et al. | 164/440 |
| 5,247,987 A | * | 9/1993 | Tavernier et al. | 164/428 |
| 5,439,046 A | * | 8/1995 | Miyazawa et al. | 164/467 |
| 6,145,581 A | * | 11/2000 | Takeuchi et al. | 164/472 |
| 6,257,315 B1 | * | 7/2001 | Spink | 164/480 |
| 6,378,598 B1 | * | 4/2002 | Tonelli et al. | 164/428 |

FOREIGN PATENT DOCUMENTS

| | | | |
|---|---|---|---|
| JP | 60051669 A | * | 3/1985 |
| JP | 60-162557 A | * | 8/1985 |
| JP | 61-286045 A | * | 12/1986 |
| JP | 62-166054 | | 7/1987 |
| JP | 01278944 A | * | 11/1989 |
| JP | 03207554 A | * | 9/1991 |
| JP | 03-207554 | | 9/1991 |
| JP | 04342468 A | * | 11/1992 |
| JP | 4-342468 A | * | 11/1992 |
| JP | 04-342468 | | 11/1992 |
| JP | 05-262566 | | 10/1993 |
| JP | 07-060411 | | 3/1995 |
| JP | 07060411 A | * | 3/1995 |
| JP | 07068354 A | * | 3/1995 |
| JP | 07-068354 | | 3/1995 |
| JP | 09155509 A | * | 6/1997 |
| JP | 09-155509 | | 6/1997 |
| WO | WO-98/35775 A | * | 8/1998 |
| WO | WO-98/35775 | * | 8/1998 |

* cited by examiner

*Primary Examiner*—Kiley S. Stoner
*Assistant Examiner*—Kevin L. McHenry
(74) *Attorney, Agent, or Firm*—Kenyon & Kenyon

(57) ABSTRACT

The present invention relates to a ceramic plate material for side dams of a twin-drum strip caster, the ceramic plate material containing Al of 9 mass % or more in terms of Al equivalent and having the properties of; bending strength at room temperature of not less than 120 MPa, bending strength at 1,000° C. of not less than 65 MPa, hardness (Hv) of 50 to 350, fracture toughness $K_{IC}$ at 1,000° C. of not less than 1 MPa·m$^{1/2}$, thermal conductivity in the temperature range from room temperature to 1,000° C. of not more than 8 W/(m·K), thermal shock resistance index R' of not less than 800 W/m, and wettability with molten steel (contact angle θ) of not less than 120°: and allows molten stainless steel to be continuously cast for a long period of time.

4 Claims, 1 Drawing Sheet

CERAMIC PLATE FOR SIDE WEIR OF TWIN DRUM TYPE CONTINUOUS CASTING APPARATUS

TECHNICAL FIELD

The present invention relates to a ceramic plate material used for side dams which interpose cooling drums from both sides and form a molten steel pool in a twin-drum strip caster used for continuously casting a cast steel while generating solidification shells on the peripheral surfaces of a pair of cooling drums each of which has an axis parallel with the other and rotates in inverse direction relative to the other.

BACKGROUND ART

In a twin-drum strip caster, basic properties such as heat resistance to withstand a molten steel temperature of about 1,600° C., thermal shock resistance to withstand a temperature difference of about 400° C., less thermal deformation (less thermal expansion coefficient), less wettability with molten steel (better detachability of a coagulation), and excellent wear resistance are required of a material used for side dams which interpose cooling drums from the both sides and form a molten steel pool (refer to Japanese Unexamined Patent Publication No. S62-166054).

At the present time, when longer service life of continuous casting tends to be required, in addition to the basic properties, excellent erosion resistance is also required of side dams, since they erode at the portions where both the cooling drums and molten steel contact them (the portions of the molten steel side along the slide planes facing the cooling drums), and if the continuous casting goes on for an extended period of time, the erosion increases and the service life of the side dams shortens (refer to Japanese Unexamined Patent Publication No. H7-68354).

However, there has been to date no ceramic plate material available which satisfies all of those requirements, and the plates have been formed by sticking or laying together different ceramic materials each of which satisfies some of the required properties at the portions where prescribed properties are required (refer to Japanese Unexamined Patent Publication Nos. H3-207554, H7-60411, etc.).

Those plates demonstrate excellent performance as side dams in the case of a short-time continuous casting operation, but are not adequate for a long-time continuous casting operation, since the performance is insufficient due to their structural restrictions.

As a ceramic plate material, boron nitride (BN) has mainly been used in spite of its high cost, since it has the advantages of satisfying many of the above required properties (heat resistance, thermal shock resistance, less thermal deformation, less wettability with molten steel, etc.), not causing cracks during actual casting, easily fitting with the drum end faces at the initial stage because of its softness, thus forming negligible clearances between the side dams and the drum end faces, and thus preventing molten steel intrusion.

However, since BN is soft, it therefore has the disadvantages in that it is abraded by the cooling drums in a short period of time and cannot withstanding a long-time continuous casting operation.

Therefore, to make up for the disadvantages of BN, some ceramic plate materials comprehensively having the properties required of side dams have been developed by combining other ceramics, for example, silicon nitride ($Si_3N_4$) and aluminum nitride (AlN), with BN.

As an example, the above-mentioned Japanese Unexamined Patent Publication No. H7-60441 discloses a ceramic plate material consisting of BN of 30 to 50 wt %, $Si_3N_4$ of 30 to 65 wt % and AlN of 5 to 15 wt %.

This plate material is a material wherein, to improve the wear resistance of BN, $Si_3N_4$, which has the advantages of withstanding a long-time casting because of excellent wear resistance and small thermal expansion and also having a low cost, and further AlN, which does not have very excellent thermal shock resistance but has good wear resistance and excellent erosion resistance, are combined with BN at the rate of 30 to 65 wt % and 5 to 15 wt %, respectively. Therefore, the plate material has moderate thermal shock resistance, wear resistance (it is preferable that the wear resistance of the plate material be moderately lower than the wear resistance of the drums) and erosion resistance, and thus demonstrates the performance desirable for side dams.

Further, Japanese Unexamined Patent Publication No. H7-68354 discloses a ceramic plate material consisting of BN of 20 to 30 wt %, $Si_3N_4$ of 55 to 77 wt % and AlN of 3 to 15 wt %. This plate material also contains AlN of 3 to 15 wt % and thus has excellent erosion resistance.

However, when side dams made out of a conventional ceramic plate material are used in the continuous casting of molten stainless steel, the erosion by the chemical reaction of alloy components in the molten steel and the mechanical erosion by the molten steel in the state of semi-solidification coact, and therefore the side dams erode radically at the portions contacting the portions where the cooling drums and the molten stainless steel contact with each other. As this kink of the erosion looks like line, the erosion may be defined as linear-wear. If the erosion of the side dams is excessive as stated above, the side dams have to be changed frequently and the operation efficiency of the caster deteriorates accordingly.

Further, since the side dams used for the continuous casting of molten stainless steel also play the role of supporting molten steel containing several kinds of alloy components in large amounts and having a large specific gravity at both sides of the cooling drums for a long time, the side dams are required to be superior than the conventional ceramic plate materials not only in erosion resistance but also in basic properties.

DISCLOSURE OF THE INVENTION

Based on the above requirements, the object of the present invention is to provide a ceramic plate material for side dams having excellent properties sufficient for the ceramic plate material to be used continuously even in the case of continuously casting molten stainless steel for a long time.

A ceramic plate material for side dams used for the continuous casting of molten stainless steel is required to have excellent basic properties as well as erosion resistance, as stated above.

In particular, when the side dams are sometimes cooled at the portions contacting the cooling drums, the cooling induces the formation and deposition of skull, and therefore the stable operation of continuous casting is hindered.

To cope with this, the present inventors focused attention on the thermal conductivity of a ceramic plate material and adopted it as an index in order to realize the excellent basic properties of the present invention.

Though wettability with molten steel has long been one of the necessary basic properties, there has been no ceramic plate material which has been evaluated and specified with any sort of concrete index in terms of degree of wettability.

In the continuous casting of molten stainless steel in particular, skull formed and deposited on side dams falls off and induces a phenomenon known as hot band (one of falling skull being caught between cooling drums and expanding the gap between them, and as a result, the cast steel being red-heated in the shape of a band along the width direction) which hinders operation, and therefore it is necessary to suppress the formation and deposition of the skull to the utmost.

Therefore, the wettability of a ceramic plate material for side dams with molten steel is an important property for the sake of operation efficiency and also the maintenance and control of product quality.

In the present invention, the present inventors focused attention on the wettability with molten steel which was not evaluated before although the wettability is an important index, and adopted it as an index for evaluating and realizing the excellent basic properties of the present invention together with other indexes.

The present invention is a ceramic plate material composed mainly of BN, $Si_3N_4$ and AlN, and in particular containing AlN, which is good for wear resistance and excellent in erosion resistance, in larger amount than that of conventional ceramic plate materials (5 to 15 wt %) in order to enhance erosion resistance.

The present inventors varied the content of AlN which enhances erosion resistance in a ceramic plate material composed mainly of BN, $Si_3N_4$ and AlN, and measured the linear-wear-proof index (an index showing the degree of erosion resistance). The results are shown in FIG. 1. As can be seen from FIG. 1, the present inventors found that in order to ensure the erosion resistance required of the side dams used for the continuous casting of molten stainless steel, it was necessary for a ceramic plate material to contain Al of 9 mass % or more in terms of Al equivalent, more concretely AlN of more than 15 mass % to not more than 40 mass %.

Further, the present inventors, as a result of intensive research on the thermal conductivity and wettability with molten steel which were adopted as indexes in the present invention, found that it was necessary for a ceramic plate material containing Al of 9 mass % or more in terms of Al equivalent to have a thermal conductivity of not more than 8 W/(m·K) and wettability with molten steel (contact angle θ) of not less than 120° in order to suppress the formation and deposition of skull.

The present invention is based on the above findings and the gist thereof is as follows:

(1) A ceramic plate material for the side dams of a twin-drum strip caster, the ceramic plate material containing Al of 9 mass % or more in terms of Al equivalent, characterized by having the properties of: bending strength at room temperature of not less than 120 MPa, bending strength at 1,000° C. of not less than 65 MPa, hardness (Hv) of 50 to 350, fracture toughness $K_{IC}$ at 1,000° C. of not less than 1 $MPa \cdot m^{1/2}$, thermal conductivity at a temperature from room temperature to 1,000° C. of not more than 8 W/(m·K), thermal shock resistance index R' of rug not less than 800 w/m, and wettability with molten steel (contact angle θ) of not less than 120°.

(2) A ceramic plate material for the side dams of a twin-drum strip caster according to the item (1), characterized by the Al content being 12.5 mass % or more in terms of Al equivalent.

(3) A ceramic plate material for the side dams of a twin-drum strip caster according to the item (1) or (2), characterized by consisting of, in terms of mass %, BN of not less than 5% to not more than 20%, AlN of more than 15% to not more than 40% and $Si_3N_4$ of not less than 40% to not more than 80%.

(4) A ceramic plate material for the side dams of a twin-drum strip caster according to the item (3), characterized by containing, in terms of mass %, BN of not less than 10% to less than 20%.

(5) A ceramic plate material for the side dams of a twin-drum strip caster according to the item (3) or (4), characterized by further containing, in terms of mass %, one or more of: $Al_2O_3$ of not less than 1% to not more than 15%, MgO of not less than 1% to not more than 15%, $ZrO_2$ of not less than 1% to not more than 30% and $Y_2O_3$ of not less than 1% to not more than 15%.

BEST MODE FOR CARRYING OUT THE INVENTION

Figure 1:
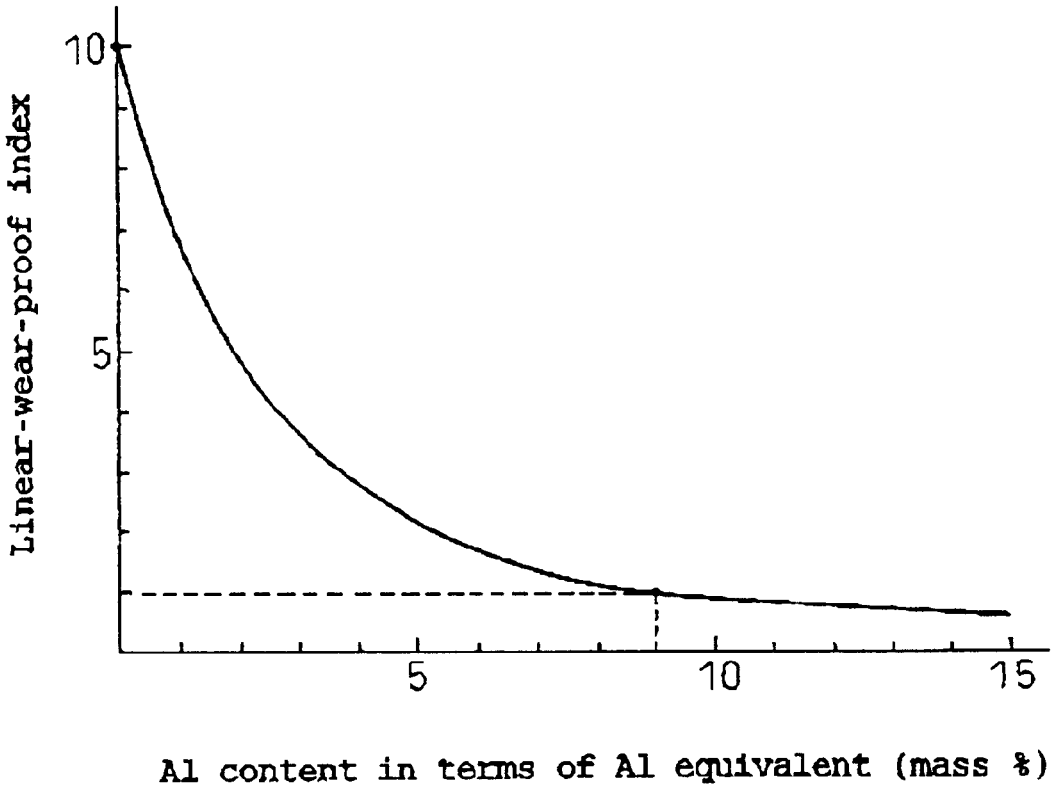
FIG. 1 is a graph showing the relation between the Al content in terms of Al equivalent and the linear-wear-proof index in a ceramic plate material composed mainly of BN, $Si_3N_4$ and AlN.

A ceramic plate material for the side dams of a twin-drum strip caster according to the present invention (hereunder referred to as the "invented material") is explained further.

The invented material is required to contain Al of not less than 9 mass % in terms of Al equivalent in order to ensure excellent erosion resistance.

When Al is present in a ceramic plate material, the Al reacts with oxygen [O] in molten steel and alumina precipitates on the surfaces of the plates in the form of a film. This alumina film ensures erosion resistance by acting as a protective film, and thus in order to obtain an alumina protective film sufficient to realize excellent erosion resistance, it is necessary for the ceramic plate material to contain Al of not less than 9 mass % in terms of Al equivalent. Therefore, the lower limit of the Al content in terms of Al equivalent is set at 9 mass %.

Another preferable Al content in terms of Al equivalent for realizing excellent erosion resistance is not less than 12.5 mass %, and a further preferable Al content is not less than 16 mass %.

A preferable Al compound used for supplying Al in the present invention is AlN, and it is necessary for the AlN to be contained in an amount exceeding 15% in order to ensure Al of not less than 9 mass % in terms of Al equivalent. However, AlN does not very good thermal shock resistance, although it has excellent erosion resistance, and therefore AlN degrades the thermal shock resistance of a ceramic plate material when added abundantly. Therefore, the upper limit of the AlN content is set at 40%.

Further, another range of AlN content of the invented material desirable for realizing excellent erosion and thermal shock resistance is from more than 15% to 35%, more preferably from 17.5% to 27.5%.

The mechanical properties of the invented material are prescribed as follows: bending strength at room temperature of not less than 120 MPa, bending strength at 1,000° C. of not less than 65 MPa, hardness (Hv) of 50 to 350, and fracture toughness $K_{IC}$ at 1,000° C. of not less than 1 $MPa \cdot m^{1/2}$.

The above properties are required because the basic mechanical properties necessary in the case of a side dams cannot be ensured if bending strength at room temperature is less than 120 MPa, bending strength at 1,000° C. is less than 65 MPa, and fracture toughness $K_{IC}$ at 1,000° C. is less than 1 MPa·$m^{1/2}$. More concretely, if the basic mechanical properties of a ceramic plate material cannot be ensured, the ceramic material will crack or break during operation due to the resistance against sliding between the ceramic material and a drum and the impact force caused by cast steel or a drum when hot band is generated, and therefore stable sealing of molten steel cannot be maintained.

Further, if the hardness (Hv) is less than 50, wear proceeds extremely rapidly exceeding an appropriate limit caused by sliding between the ceramic material and a drum, and thus the service life of a side dam is short.

On the other hand, if the hardness (Hv) exceeds 350, desired wear does not happen in contrast, conformability (adhesiveness) between a drum and a ceramic material cannot be ensured, and as a result, the sealing of molten steel becomes unstable.

Other preferable mechanical properties of an invented material are: bending strength at room temperature of not less than 150 MPa, bending strength at 1,000° C. of not less than 80 MPa, hardness (Hv) of 100 to 200, fracture toughness $K_{IC}$ at 1,000° C. of not less than 1.5 MPa·$m^{1/2}$: and further preferable mechanical properties are; bending strength at room temperature of not less than 200 MPa, bending strength at 1,000° C. of not less than 100 MPa, hardness (Hv) of 130 to 170, fracture toughness $K_{IC}$ at 1,000° C. of not less than 2 MPa·$m^{1/2}$.

The thermal properties of the invented material are prescribed as follows: thermal conductivity of not more than 8 W/(m·K), and thermal shock resistance index R' ($=S(1-\nu)\lambda/E\alpha$) of not less than 800 W/m.

Here, the thermal shock resistance index R' is an index which shows whether the thermal shock resistance is good or bad, and at least 800 W/m is required of the invented material in order to realize excellent thermal shock resistance.

In thermal shock resistance index R' ($=S(1-\nu)\lambda/E\alpha$), S represents fracture strength, $\nu$ Poisson's ratio, $\lambda$ thermal conductivity, E Young's modulus, and $\alpha$ thermal expansion coefficient.

It is a feature of an invented material to focus attention or the thermal conductivity and specify its proper range, in addition to the thermal shock resistance index, as the thermal properties of the invented material.

With regard to a ceramic plate material, even if its thermal shock resistance is good, if its thermal conductivity is high, the portion where the ceramic plate material directly contacts a cooling drum is cooled by the cooling drum and skull forms and deposits, even grow into huge one sometimes at said portion. If skull sticking to a side dams falls off accidentally, a hot band (a red-heated band appearing along the width direction of cast steel) will frequently appear on cast steel as explained above, and thus preventing a stable continuous casting operation.

The present inventors had an idea that the thermal conductivity of a ceramic plate material should be lower in order to make the long-lasting and stable continuous casting operation possible, and intensively investigated a proper range of the thermal conductivity.

As a result, it was confirmed that long lasting and stable continuous casting operation could be maintained without the formation and deposition of skull by using a ceramic plate material having a thermal conductivity of not more than 8 W/(m·K).

Therefore, with regard to the thermal properties of the invented material, not only is thermal shock resistance index R' specified to be not less than 800 W/m, but thermal conductivity is also specified to be not more than 8 W/(m·K).

Further, other preferable thermal properties of the invented material are a thermal conductivity of not more than 6 W/(m·K), and a thermal shock resistance index R' of not less than 1,200 w/m; and more preferable thermal properties thereof are a thermal conductivity of not more than 4 W/(m·K), and a thermal shock resistance index R' of not less than 1,500 W/m.

With regard to the chemical properties of the invented material, erosion resistance is maintained at a high level by controlling the Al content to be not less than 9 mass % in terms of Al equivalent, and wettability with molten steel (contact angle $\theta$) is specified to be not less than 120°.

Basically, the lower the wettability with molten steel, the better the performance of the material. Though this has been known from the past, the concrete proper range thereof has not been regarded as an object of investigation and research.

The present inventors, as a result of intensive investigation into the proper range, found that it was necessary to maintain the wettability with molten steel (contact angle $\theta$) at not less than 120° for further suppressing the formation and deposition of skull on a side dam and ensuring a long-lasting and stable continuous casting operation.

In this investigation, casting was conducted using various kinds of ceramic materials whose wetting angle with SUS304 molten steel was measured with a high temperature microscope as actual plate materials, and the amount and size of hot band (the adhesiveness of skull) and the degree of molten steel intrusion at a portion where molten steel was sealed were evaluated As a result, it was found that a ceramic material having a contact angle of not less than 120° could be stably used as a plate material.

For that reason, the lower limit of the proper range of wettability with molten steel (contact angle $\theta$) is set at 120° for the invented material.

Another preferable wettability (contact angle $\theta$) of the invented material is not less than 130°, and more preferable wettability (contact angle $\theta$) is not less than 150°.

The invented material is characterized by containing, as its components, in terms of mass %, BN of not less than 5% to not more than 20%, AlN of more than 15% to not more than 40%, and $Si_3N_4$ of not less than 40% to not more than 80%, in order to ensure the desired mechanical, thermal and chemical properties.

$Si_3N_4$ is used as one of the main components, but if its content is less than 40%, the required strength, hardness, wear resistance, etc. cannot be obtained, and therefore the lower limit is set at 40%.

On the other hand, if $Si_3N_4$ is added in excess of 80%, the proper balance between wear resistance and fracture toughness cannot be obtained, and therefore the upper limit is set at 80%.

Another preferable range of $Si_3N_4$ content is 50 to 70%, and more preferable range thereof is 55 to 65%.

BN is a ceramic material which has been used in the past, and it is contained in the invented material within a range whose upper limit is 20%. This is due to the fact that if it is contained in excess of 20%, the level of wear resistance required of the invented material cannot be obtained, though desired thermal properties can be obtained.

However, if its content is less than 5%, the level of thermal properties and wettability required of the invented material cannot be obtained, and therefore the lower limit is set at 5%.

Another preferable range of BN is 10 to less than 20%, and more preferable range thereof is 12.5 to 17.5%.

The range of AlN is the same as stated above.

The invented material contains BN, AlN and $Si_3N_4$ as its main components, and also may contain one or more kinds of other ceramic materials within a range not detrimental to the required properties of the invented material; such as $Al_2O_3$ of not less than 2% to not more than 15%, MgO of not less than 1% to not more than 15%, $ZrO_2$ of not less than 1% to not more than 30%, and $Y_2O_3$ of not less than 1% to not more than 15%.

EXAMPLE

Side dams were constructed using a ceramic material (BN: 15% and $Si_3N_4$: 60%) containing Al of 15 mass % in terms of Al equivalent and having the properties of: bending strength at room temperature of 180 MPa, bending strength at 1,000° C. of 100 MPa, hardness (Hv) of 150, fracture toughness $K_{IC}$ at 1,000° C. of 1.5 MPa·m$^{1/2}$, thermal conductivity in the temperature range from room temperature to 1,000° C. of 6 W/(m·K), thermal shock resistance index R' of 1,300 W/m, and wettability with molten steel (contact angle θ) of 130° C., and continuous casting of molten stainless steel was conducted. As a result, ten consecutive of six heat continuous casting operations (total steel weight: 360 tons) could be performed.

COMPARATIVE EXAMPLE

Side dams were constructed using a ceramic plate material not conforming to the conditions specified in the present invention, and continuous casting of molten stainless steel was conducted. The results are set out below.

(1) In the case of side dams using a ceramic material containing Al of 5 mass % in terms of Al equivalent and comprising BN of 20% and $Si_3N_4$ of 70%, the erosion of the portions of the ceramic material which contact the portions where cooling drums and molten steel contact with each other was excessive, and the sealing of the molten steel was compromised and thus the operation was stopped when the amount of cast steel reached 100 tons.

(2) In the case of side dams using a ceramic material having the properties of; bending strength at room temperature of 80 MPa, bending strength at 1,000° C. of 40 MPa, and fracture toughness $K_{IC}$ at 1,000° C. of 0.8 MPa·m$^{1/2}$, the ceramic material broke off at the lowest portion, and the sealing of the molten steel was compromised and thus the operation was stopped when the amount of cast steel reached 100 tons.

(3) In the case of side dams using a ceramic material having thermal conductivity in the temperature range from room temperature to 1,000° C. of 15 W/(m·K), the amount of skull deposited on ceramic dams during operation was large and hot band frequently occurred, and when the amount of cast steel reached 90 tons, a large hot band was generated and the cast steel broke.

(4) In the case of side dams using a ceramic material having wettability with molten steel (contact angle θ) of 90°, the amount of skull deposited on ceramic dams was large from immediately after start of the operation and hot band frequently occurred, and since the quality of cast steel could not be maintained at a desired level, the operation was stopped when the amount of cast steel reached 120 tons.

(5) In the case of side dams using a ceramic material having a hardness (Hv) of 40, wear of the w ceramic material proceeded quickly during operation, and when the amount of cast steel reached 60 tons, the operation was stopped, since the amount of wear had reached the allowable limit.

(6) In the case of side dams using a ceramic material having a hardness (Hv) of 400, the ceramic material did not wear from the initial stage of the operation, the sliding conformance between the side dams and the cooling drums remained inferior, molten steel could not be sealed stably, and as a result, the operation was stopped when the amount of cast steel reached 30 tons.

(7) In the case of side dams using a ceramic material having a thermal shock resistance index R' of 500 W/m, the ceramic material broke off at the initial stage of the operation, and as a result, the operation was stopped when the amount of cast steel reached 15 tons.

INDUSTRIAL APPLICABILITY

According to the present invention, even though the amount of casting per one operation increases in the continuous casting of molten stainless steel, the operation can be carried out stably and continuously for a long period of time, and therefore cast steel having a uniform composition and structure can be obtained with high production efficiency.

Therefore, the present invention greatly contributes to the development of continuous casting technology in the field of stainless steel.

What is claimed is:

1. A ceramic plate material for the side dams of a twin-drum strip caster, the ceramic plate material consisting of, in terms of mass %, BN of not less than 5% to not more than 20%, AlN of more than 15% to not more than 40% and $Si_3N_4$ of not less than 40% to not more than 80%, Al of 9 mass % or more in terms of Al equivalent, and having the properties of: bending strength at room temperature of not less than 120 MPa, bending strength at 1,000° C. of not less than 65 MPa, hardness (Hv) of 50 to 350, fracture toughness $K_{IC}$ at 1,000° C. of not less than 1 MPa·m$^{1/2}$, thermal conductivity at a temperature from room temperature to 1,000° C. of not more than 8 W/(m·K), thermal shock resistance index R' of not less than 800 W/m, and wettability with molten steel (contact angle θ) of not less than 120°.

2. A ceramic plate material for the side dams of a twin-drum strip caster according to claim 1 characterized by containing, in terms of mass %, BN of not less than 10% to less than 20%.

3. A ceramic plate material for the side dams of a twin-drum strip caster, the ceramic plate material consisting of, in terms of mass %, BN of not less than 5% to not more than 20%, AlN of more than 15% to not more than 40% and $S_3N_4$ of not less than 40% to not more than 80%, Al of 9 mass % or more in terms of Al equivalent, one or more of: $Al_2O_3$ of not less than 1% to not more than 15%, MgO of not less than 1% to not more than 15%, $ZrO_2$ of not less than 1% to not more than 30% and $Y_2O_3$ of not less than 1% to not more than 15%, and having the properties of: bending strength at room temperature of not less than 120 MPa, bending strength at 1,000° C. of not less than 65 MPa, hardness (Hv) of 50 to 350, fracture toughness $K_{IC}$ at 1,000° C. of not less than 1 $MPa \cdot m^{1/2}$, thermal conductivity at a temperature from room temperature to 1,000° C. of not more than 8 W/(m·K), thermal shock resistance index R' of not less than 800 W/m, and wettability with molten steel (contact angle θ) of not less than 120°.

4. A ceramic plate material for the side dams of a twin-drum strip caster according to claim 3 characterized by containing, in terms of mass %, BN of not less than 10% to less than 20%.

* * * * *